US010611158B2

(12) United States Patent
Nakamura et al.

(10) Patent No.: US 10,611,158 B2
(45) Date of Patent: Apr. 7, 2020

(54) LIQUID EJECTING APPARATUS

(71) Applicant: SEIKO EPSON CORPORATION, Tokyo (JP)

(72) Inventors: Hiroyuki Nakamura, Shiojiri (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/055,373

(22) Filed: Aug. 6, 2018

(65) Prior Publication Data

US 2019/0039379 A1 Feb. 7, 2019

(30) Foreign Application Priority Data

Aug. 7, 2017 (JP) ..... 2017-152237

(51) Int. Cl.

| | |
|---|---|
| ***B41J 2/01*** | (2006.01) |
| ***B41J 2/165*** | (2006.01) |
| ***B41J 2/21*** | (2006.01) |
| ***B41J 11/00*** | (2006.01) |

(52) U.S. Cl.

CPC ..... *B41J 2/16544* (2013.01); *B41J 2/16526* (2013.01); *B41J 2/16538* (2013.01); *B41J 2/16585* (2013.01); *B41J 2/2114* (2013.01); *B41J 11/0015* (2013.01); *B41J 2002/1655* (2013.01)

(58) Field of Classification Search

USPC ..... 347/21, 101

See application file for complete search history.

(56) References Cited

U.S. PATENT DOCUMENTS

| | | | | |
|---|---|---|---|---|
| 5,670,996 | A | 9/1997 | Mitani | |
| 7,922,279 | B2 | 4/2011 | Hibbard et al. | |
| 8,251,504 | B2 * | 8/2012 | Viturro | B41J 15/04 347/101 |
| 9,421,778 | B2 | 8/2016 | Shindo | |
| 2005/0093919 | A1 | 5/2005 | Takatsuka et al. | |
| 2007/0046720 | A1 * | 3/2007 | Konno | B41J 2/2114 347/21 |
| 2008/0218554 | A1 | 9/2008 | Inoue | |
| 2009/0244173 | A1 | 10/2009 | Yokouchi | |
| 2012/0062628 | A1 * | 3/2012 | Nagai | B41J 2/16517 347/9 |

FOREIGN PATENT DOCUMENTS

| | | |
|---|---|---|
| JP | H10-147035 A | 6/1998 |
| JP | 2007-008701 A | 1/2007 |
| JP | 2009-084005 A | 4/2009 |

OTHER PUBLICATIONS

European Search Report issued in Application No. 18187421 dated Dec. 6, 2018.

* cited by examiner

*Primary Examiner* — Lam S Nguyen

(74) *Attorney, Agent, or Firm* — Workman Nydegger

(57) ABSTRACT

A liquid ejecting apparatus includes a liquid ejecting head which performs a printing by ejecting liquid onto a medium from a nozzle, a wiping portion which wipes the liquid ejecting head by moving relative to the liquid ejecting head, a maintenance unit which performs a maintenance to forcibly discharge the liquid from the nozzle, and a preprocessing device which performs a preprocessing on the medium before the printing is performed, in which when the wiping portion and the liquid ejecting head are separated from each other in the wiping not accompanying the maintenance, the wiping portion is displaced in a direction away from the preprocessing device.

13 Claims, 7 Drawing Sheets

LIQUID EJECTING APPARATUS

BACKGROUND

1. Technical Field

The present invention relates to a liquid ejecting apparatus such as a printer.

2. Related Art

In the related art, there is a liquid ejecting apparatus (a recording apparatus) such as a printer which discharges a liquid such as an ink from a liquid ejecting head (a recorder) onto a medium such as paper which is fed to a medium support unit (a platen) to print (record) an image including characters and figures onto the medium.

In the liquid ejecting apparatus (the recording apparatus), an apparatus which is configured to include a foreign matter removing device which performs a foreign matter removal process and to prevent a reduction in quality of printing (recording) caused by the foreign matter such as paper dust is provided between a feeding unit of the medium and a recorder as a preprocessing device which performs preprocessing before performing the printing (the recording) on the medium (for example, JP-A-10-147035).

Generally, in the liquid ejecting apparatus, wiping the liquid ejecting head using a wiper (a wiping portion) is performed for the maintenance or the like in which the discharging properties of the liquid from the liquid ejecting head are maintained. In this case, although a foreign matter removing device is included between the feeding unit of the medium and the recorder as a preprocessing device in the liquid ejecting apparatus of the related art, no consideration is given to a foreign matter which is scattered by the wiping of the liquid ejecting head. Therefore, there is a concern that the foreign matter which is scattered by the wiping will reach the preprocessing device, cause a deterioration in the processing capability of the preprocessing device, and lead to a reduction in the print quality.

This problem is generally common in liquid ejecting apparatuses which are provided with a preprocessing device which performs preprocessing before the printing is performed on the medium and a wiping portion which moves relative to a liquid ejecting head, which discharges a liquid, and wipes the liquid ejecting head.

SUMMARY

An advantage of some aspects of the invention is to provide a liquid ejecting apparatus capable of suppressing deterioration of the processing capability of a preprocessing device caused by a foreign matter.

According to an aspect of the invention, there is provided a liquid ejecting apparatus which includes a liquid ejecting head which discharges a liquid onto a medium from a nozzle to perform printing, a wiping portion which moves relative to the liquid ejecting head to perform wiping of the liquid ejecting head, a maintenance unit which performs maintenance, which causes the liquid to be forcefully discharged from the nozzle, on the liquid ejecting head, and a preprocessing device which performs preprocessing on the medium before the printing is performed, in which during the wiping which does not accompany the maintenance, when the wiping portion and the liquid ejecting head are separated, the wiping portion is displaced in a direction separating from the preprocessing device.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, the first embodiment of the liquid ejecting apparatus will be described with reference to the drawings.

Figure 1:
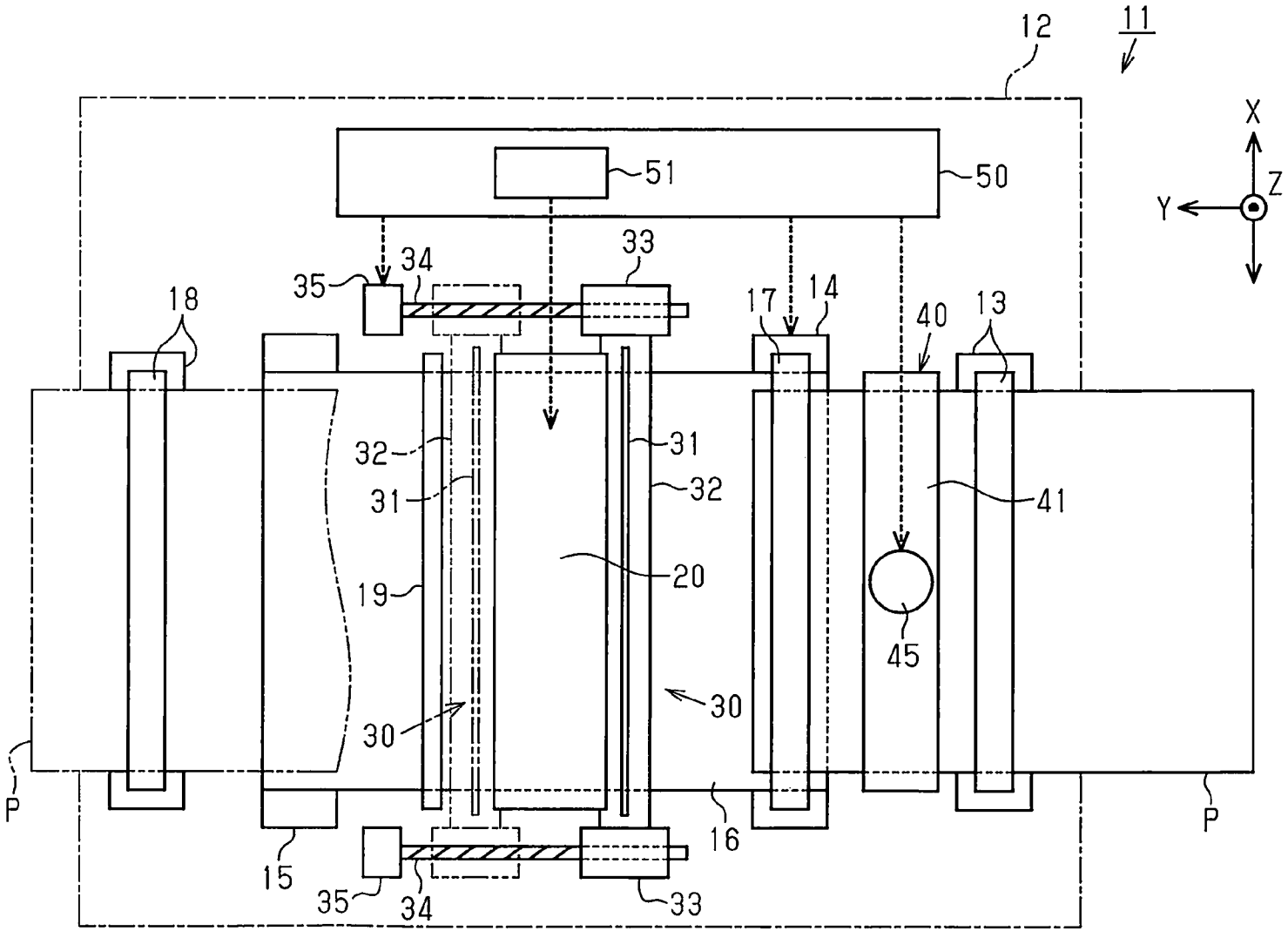
FIG. 1 is a plan view schematically illustrating the configuration of a liquid ejecting apparatus of a first embodiment.
Figure 2:
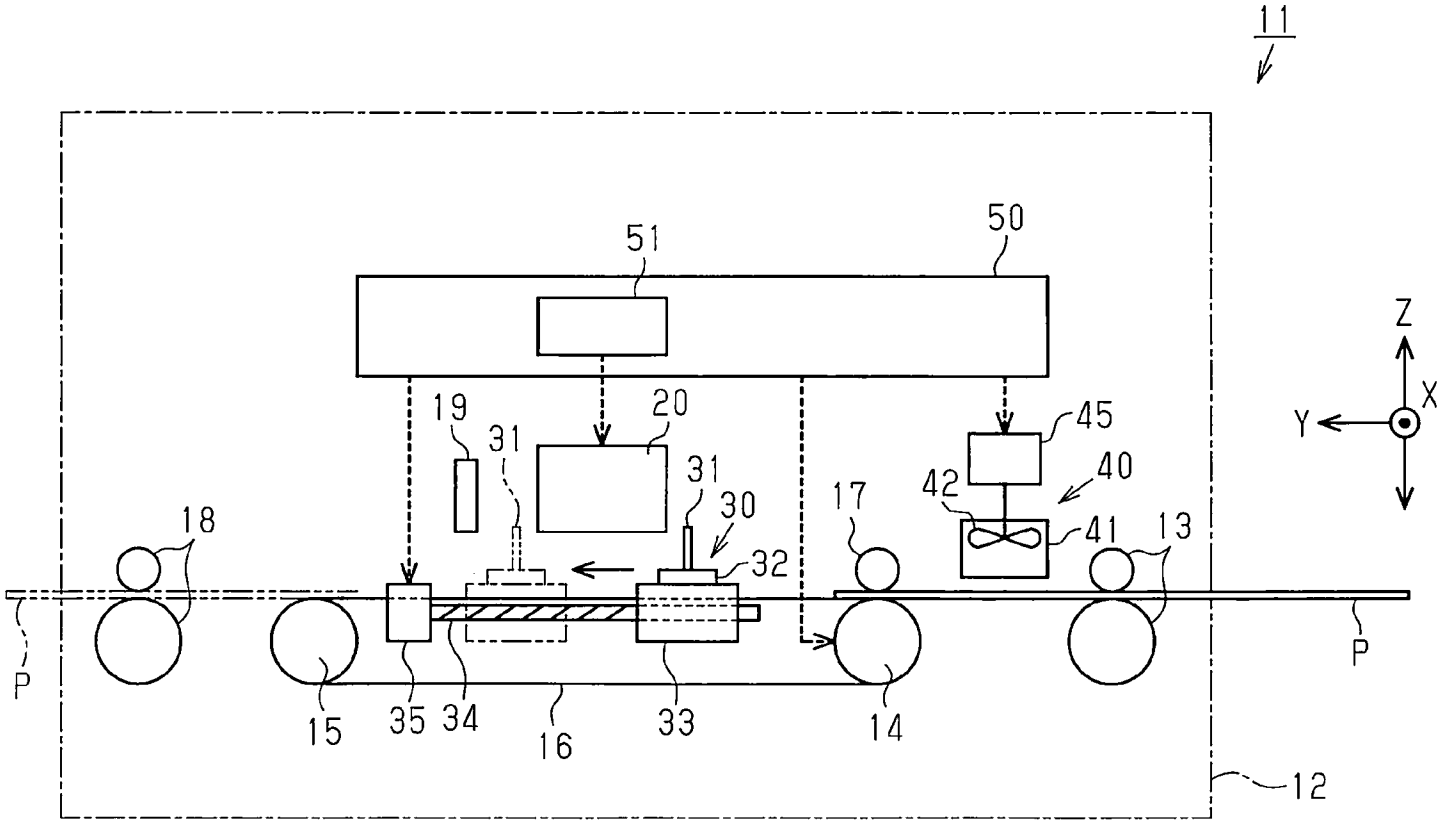
FIG. 2 is a side view schematically illustrating the configuration of the liquid ejecting apparatus of the first embodiment.

As illustrated in FIGS. 1 and 2, a liquid ejecting apparatus 11 of the first embodiment is a line head type ink jet printer which discharges (ejects) an ink which is an example of a liquid from a fixed liquid ejecting head 20 onto a paper P which is an example of a medium to print (record) an image or the like including characters and figures.

In other words, the liquid ejecting apparatus 11 is provided with a paper feed roller pair 13, a support belt 16, and a feed roller 17. The paper feed roller pair 13 supplies the paper P inside a main body case 12, the support belt 16 is an example of a medium support unit which is provided at a position facing the liquid ejecting head 20 and supports the paper P, and the feed roller 17 feeds the paper P to the support belt 16. The liquid ejecting apparatus 11 is provided with a paper discharge roller pair 18 which discharges the paper P onto which the ink is ejected to print an image or the like from a paper discharge port which is provided in the main body case 12.

The support belt 16 is an endless belt which is stretched between two rollers 14 and 15, and the roller 14 which is one of the two rollers 14 and 15 forms a roller pair with the feed roller 17, interposing the support belt 16. In this embodiment, due to the roller 14 being rotationally driven by a driving source (not illustrated), the support belt 16 revolves and the feed roller 17 pinches, between itself and the support belt 16 which revolves, and rotates following the paper P which is supplied by the paper feed roller pair 13. Through the rotation, the feed roller 17 transports the paper P in a transport direction Y which is the direction heading toward the roller 15 which is the feed direction while supporting the paper P on the top side which is the anti-gravity direction side of the support belt 16 in a vertical direction Z.

The liquid ejecting apparatus 11 is provided with the liquid ejecting head 20, a wiper 30, and a preprocessing device 40. The liquid ejecting head 20 discharges the ink onto the paper P which is transported on the support belt 16 to perform the printing, the wiper 30 moves relative to the liquid ejecting head 20 to perform the wiping of the liquid ejecting head 20, and the preprocessing device 40 performs the preprocessing before the printing is performed on the paper P.

The liquid ejecting head 20 is a so-called line head in which nozzles (not illustrated) are formed along a width direction X which is the longitudinal direction orthogonally intersecting the transport direction Y of the paper P which is transported on the support belt 16 by the feed roller 17 and is fixed to the inside of the main body case 12 of the liquid ejecting apparatus 11 in a state in which the liquid ejecting head 20 does not move in at least the transport direction Y. Drive elements such as piezoelectric elements which cause the ink which is supplied to the liquid ejecting head 20 to be discharged from the nozzles are provided in the liquid ejecting head 20. The ink is discharged from the nozzles onto the paper P which is supported and transported by the support belt 16 and ink dots of predetermined sizes are formed on the paper P to print an image or the like due to predetermined drive signals being input to the drive elements.

The wiper 30 includes a wiper blade 31 which is an example of the wiping portion which extends in the width direction X and a blade holding body 32 which holds the wiper blade 31. Both ends of the blade holding body 32 in the width direction X are formed as sliding bodies 33. In this embodiment, a so-called ball screw movement mechanism is configured between each of the sliding bodies 33 of both ends and a screw shaft 34 which is rotated by a corresponding driving source 35 and the sliding bodies 33 move along the transport direction Y in accordance with the rotation of the screw shafts 34. As illustrated by the solid line and the double dot chain line in FIGS. 1 and 2, the wiper 30 (the wiper blade 31) moves substantially parallel to the transport direction Y which is the short direction between an upstream side position and a downstream side position with respect to the liquid ejecting head 20 in accordance with the movement of the sliding body 33 by the movement mechanism. In this embodiment, as illustrated by the solid line arrow in FIG. 2, the wiper 30 (the wiper blade 31) performs the wiping of the liquid ejecting head 20 by moving from the upstream side position to the downstream side position.

In this embodiment, the preprocessing device 40 is a foreign matter removing device which performs a process of removing at least a portion of the foreign matter which adheres to the paper P as the preprocessing. In detail, the preprocessing device 40 is a suction device which includes a suction unit 41. A fan 42 which may be driven (rotated) by a driving source 45 such as a motor which is provided in the liquid ejecting apparatus 11 is embedded in the suction unit 41. In other words, the suction unit 41 has a substantially rectangular parallelepiped shape in which the width direction X of the paper P is the longitudinal direction and sucks a foreign matter, such as paper dust which adheres to the paper P, together with the atmosphere which is sucked in accordance with the rotation of the fan 42 from an opening (not illustrated) which is provided on the bottom side of the suction unit 41 facing the paper P. As a result, the preprocessing device 40 is capable of removing at least a portion of the foreign matter which adheres to the paper P. The preprocessing device 40 is disposed closer to the upstream side than the liquid ejecting head 20 in the transport direction Y of the paper P and still closer to the upstream side than the feed roller 17 in the transport direction Y of the paper P.

The liquid ejecting apparatus 11 is provided with a control unit 50 which has a computer function and controls the printing operation onto the paper P, the operations of the wiper 30, and the preprocessing device 40 based on a predetermined program. In other words, the control unit 50 performs the control of the operation of revolving the support belt 16 (rotating the roller 14) and controls a discharge operation which causes the ink to be discharged from the nozzles by outputting predetermined drive signals to the liquid ejecting head 20. The control unit 50 performs output control of the drive signals to the driving sources 35 of the screw shafts 34 which move the wiper 30 (the wiper blade 31) through rotation and performs output control of the drive signals to the driving source 45 of the fan 42 of the preprocessing device 40.

In this embodiment, the liquid ejecting head 20 is capable of executing preliminary ejection which discharges the ink separately from the printing in order to stabilize the meniscus of the ink inside the nozzles on the liquid ejecting head 20 before the printing by the control unit 50 outputting discharge drive signals which cause the ink to be discharged separately from the printing to the liquid ejecting head 20.

The liquid ejecting apparatus 11 is provided with a maintenance unit 51 which performs the maintenance which causes the ink to be forcefully discharged from the nozzles on the liquid ejecting head 20. In this embodiment, the maintenance unit 51 functions due to the control unit 50 outputting a maintenance drive signal to the liquid ejecting head 20. In detail, the maintenance unit 51 outputs the maintenance drive signal to a pressurizing unit (not illustrated) which is provided upstream of the liquid ejecting head 20 to pressurize the ink inside the nozzles on the liquid ejecting head 20 using the pressurizing unit and perform the maintenance which causes the ink to be forcefully discharged to the outside of the nozzles. The maintenance unit 51 may output a maintenance drive signal which is different from the printing drive signal to the drive elements to perform the maintenance which causes the ink inside the nozzles on the liquid ejecting head 20 to be forcefully discharged to the outside of the nozzles. Unnecessary ink (for example, ink having an increased viscosity) and a foreign matter such as bubbles inside the nozzles are discharged through the discharging of the ink through the maintenance of the liquid ejecting head 20 and the discharging properties of the nozzles are maintained.

In the liquid ejecting apparatus 11 of this embodiment, when the maintenance is performed by the maintenance unit 51, the wiper 30 (specifically, the wiper blade 31) wipes the liquid ejecting head 20 to remove the unnecessary ink which is forcefully discharged from the nozzles from the liquid ejecting head 20. In other words, the wiping which accompanies the maintenance in which the liquid ejecting head 20 is wiped in a state in which the ink is forcefully discharged from the nozzles is performed.

In the liquid ejecting apparatus 11 of this embodiment, when the maintenance is performed by the maintenance unit 51, the wiper 30 (specifically, the wiper blade 31) wipes the liquid ejecting head 20. In other words, the wiping (also referred to as dry wiping) which does not accompany the maintenance in which the liquid ejecting head 20 is wiped in a state in which the ink is not forcefully discharged from the nozzles is performed.

Next, a description will be given of the dry wiping of the wiper 30 which does not accompany the maintenance of the liquid ejecting head 20 with reference to the drawings. The dry wiping of the wiper 30 is performed each time a defined number of sheets of the paper P are printed, for example.

Figure 3:
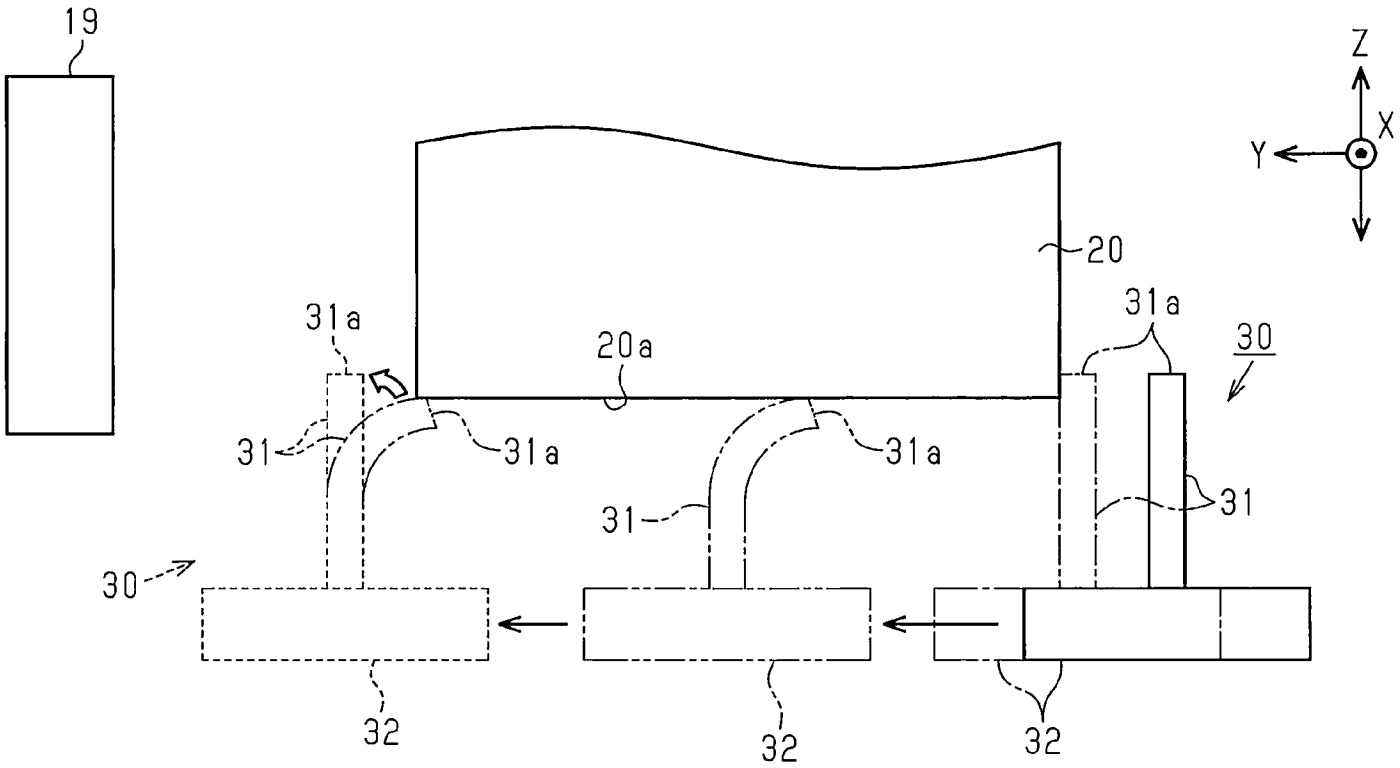
FIG. 3 is a side view illustrating a wiping portion which wipes a liquid ejecting head.

As illustrated in FIG. 3, in the wiper 30, in the dry wiping, the wiper blade 31 moves from the position on the upstream side in the transport direction Y as illustrated by the solid line in FIG. 3 to the position on the downstream side in the transport direction Y as illustrated by the dashed line in FIG. 3 with respect to the fixed liquid ejecting head 20. A top end 31*a* on the anti-gravity direction side of the wiper blade 31 in the vertical direction Z is positioned closer to the anti-gravity direction side in the vertical direction Z than a bottom surface 20*a* in which the nozzles on the liquid ejecting head 20 are formed, as illustrated by the dot-dash line in FIG. 3.

In this embodiment, the wiper blade 31 is a member which is formed of rubber or an elastomer resin and has elastically deformable flexibility. Therefore, after the wiper blade 31 comes into contact with the liquid ejecting head 20 as illustrated by the dot-dash line in FIG. 3, the wiper blade 31 moves toward the downstream side in the transport direction Y in a state in which the distal end of the wiper blade 31 is elastically deformed into a curved shape which is flexed to the upstream side in the transport direction Y as illustrated by the double-dot-dashed line in FIG. 3.

Subsequently, when the wiper 30 moves to the position on the downstream side in the transport direction Y, the contact between the top end 31*a* of the wiper blade 31 and the liquid ejecting head 20 (the bottom surface 20*a*) is released. Therefore, in the wiper blade 31 which is elastically deformed into a curved shape in which the top end 31*a* is at the upstream side in the transport direction Y, the top end 31*a* which is released from the contact moves toward the downstream side in the transport direction Y on the opposite side from the side at which the preprocessing device 40 is positioned due to a repulsion force caused by the elasticity. In other words, when the top end 31*a* of the wiper blade 31 separates from the liquid ejecting head 20 after the wiping of the liquid ejecting head 20 is performed, the wiper blade 31 moves (is displaced) from the position on the upstream side in the transport direction Y illustrated by the double-dot-dashed line in FIG. 3 to the position on the downstream side in the transport direction Y illustrated by the dashed line in FIG. 3 as illustrated by the white filled arrow in FIG. 3. In other words, the wiper blade 31 moves (is displaced) in a direction separating from the preprocessing device 40 (refer to FIG. 2) which is positioned on the upstream side in the transport direction Y. At this time, the direction in which the foreign matter which adheres to the wiper blade 31 flies is the movement (displacement) direction of the wiper blade 31.

In this embodiment, after wiping the liquid ejecting head 20, the wiper 30 moves from the position on the downstream side in the transport direction Y illustrated by the dashed line in FIG. 3 to the original position from before the wiping on the upstream side in the transport direction Y illustrated by the solid line in FIG. 3. In this embodiment, although description using the drawings is omitted, a configuration is adopted in which, during the movement, the wiper 30 moves (descends) to the gravity direction side in the vertical direction Z such that the wiper blade 31 (the top end 31*a*) does not contact the bottom surface 20*a* of the liquid ejecting head 20. Naturally, a configuration may be adopted in which the liquid ejecting head 20 moves (rises) to the anti-gravity direction side in the vertical direction Z.

In this embodiment, the liquid ejecting apparatus 11 is further provided with a cleaning portion 19 which performs the cleaning of the wiper blade 31 (refer to FIGS. 1 and 2). The cleaning portion 19 is formed of an absorbent member such as a cloth or a sponge to which the foreign matter and ink adhere or may be absorbed and is installed closer to the downstream side in the transport direction Y than the position at which the wiper blade 31 separates from the liquid ejecting head 20. In other words, the cleaning portion 19 is provided at a position which is farther from the position at which the wiper blade 31 separates from the liquid ejecting head 20 with respect to the preprocessing device 40. In this embodiment, in a case in which the cleaning by the cleaning portion 19 of the wiper blade 31 is performed, the wiper 30 moves to a position at which the wiper blade 31 comes into contact with the cleaning portion 19.

A description will be given of the actions (operations) of the liquid ejecting apparatus 11 of the first embodiment.

In this embodiment, when the wiping which does not accompany the maintenance is executed after the printing, after the printing is completed and before the wiping is started, the driving of the preprocessing device 40, that is, the rotation of the fan 42 is stopped. Here, this action is performed by stopping the output of the drive signal to the driving source 45 of the preprocessing device 40 before outputting the drive signal to the driving source 35 of the screw shaft 34 during a period in which the control unit 50 does not output the maintenance drive signal to the liquid ejecting head 20.

As another action, when the wiping which does not accompany the maintenance is executed after the printing, the driving of the preprocessing device 40, that is the rotation of the fan 42 is stopped by the time at which the wiper blade 31 finishes wiping the liquid ejecting head 20. Here, this action is performed by stopping the output of the drive signal to the driving source 45 of the preprocessing device 40 before outputting of the drive signal to the driving source 35 of the screw shaft 34 is stopped during a period in which the control unit 50 does not output the maintenance drive signal to the liquid ejecting head 20.

As another action, when the printing is executed after the wiping which does not accompany the maintenance, the driving of the preprocessing device 40, that is, the rotation of the fan 42 is started after a defined time is elapsed from when the liquid ejecting head 20 executes the preliminary ejection, after the wiping (the dry wiping) of the liquid ejecting head 20 is performed by the wiper blade 31. Here, this action is performed by outputting the drive signal to the driving source 45 of the preprocessing device 40 once a defined time is elapsed from the time at which the discharge drive signal is output to the liquid ejecting head 20 to cause the liquid ejecting head 20 to perform the preliminary ejection after outputting of the drive signal to the driving source 35 of the screw shaft 34 is stopped during a period in which the control unit 50 does not output the maintenance drive signal to the liquid ejecting head 20. For example, the defined time may be the time until the mist (ink mist) which floats according to the preliminary ejection falls, or alternatively, may be the time until the mist which floats according to the preliminary ejection is sucked up by a mist adsorption device (not illustrated) which is provided in the vicinity of the liquid ejecting head 20.

According to the first embodiment which is described above, it is possible to obtain the following effects.

(1) Since the foreign matter which flies when the liquid ejecting head 20 and the wiper blade 31 are separated does not easily reach the periphery of the preprocessing device 40, it is possible to suppress a deterioration in the processing capability of the preprocessing device 40 caused by the foreign matter.

(2) Since the foreign matter which flies when the liquid ejecting head 20 and the wiper blade 31 are separated does not easily reach the periphery of the foreign matter removing device which is the preprocessing device 40, it is possible to suppress a deterioration in the foreign matter removal processing capability of the preprocessing device 40 originating in dirtying or the like by the foreign matter.

(3) Since, after performing the printing, the driving of the preprocessing device 40 (here, the rotation of the fan 42) is stopped before performing the wiping of the liquid ejecting head 20 by the wiper blade 31, the likelihood of the foreign matter which is removed from the liquid ejecting head 20 reaching the periphery of the preprocessing device 40 due to the suction of the preprocessing device 40, for example, is reduced. Therefore, it is possible to suppress the deterioration originating in dirtying or the like by the foreign matter with respect to the processing capability of the preprocessing device 40.

(4) Alternatively, since, after performing the printing, the driving of the preprocessing device 40 is stopped by the time at which the wiping of the liquid ejecting head 20 by the wiper blade 31 is completed, the likelihood of the foreign matter which is removed from the liquid ejecting head 20 reaching the periphery of the preprocessing device 40 due to the suction of the preprocessing device 40, for example, is reduced. Therefore, it is possible to suppress the deterioration originating in dirtying or the like by the foreign matter with respect to the processing capability of the preprocessing device 40.

(5) It is possible to stabilize the meniscus of the nozzles on the liquid ejecting head 20 and it is possible to suppress the mist which floats according to the preliminary ejection reaching the periphery of the preprocessing device 40 by performing the preliminary ejection after the wiping by the wiper blade 31.

(6) Since the foreign matter which adheres to the cleaning portion 19 does not easily reach the periphery of the preprocessing device 40, it is possible to suppress a deterioration in the processing capability of the preprocessing device 40 caused by dirt or the like.

(7) Since the preprocessing device 40 is disposed closer to the upstream side than the feed roller 17 in the transport direction Y which is the feed direction of the paper P, the foreign matter which adheres to the paper P does not easily adhere to the liquid ejecting head 20 which is disposed closer to the downstream side than the feed roller 17 in the transport direction Y of the paper P. Therefore, it is possible to suppress discharge faults of the liquid ejecting head 20.

Second Embodiment

Next, a description will be given of the second embodiment of the liquid ejecting apparatus with reference to the drawings. In the second embodiment, constituent elements that are the same as those of the first embodiment will be given the same reference numerals and the description thereof will be omitted, as appropriate.

Figure 4:
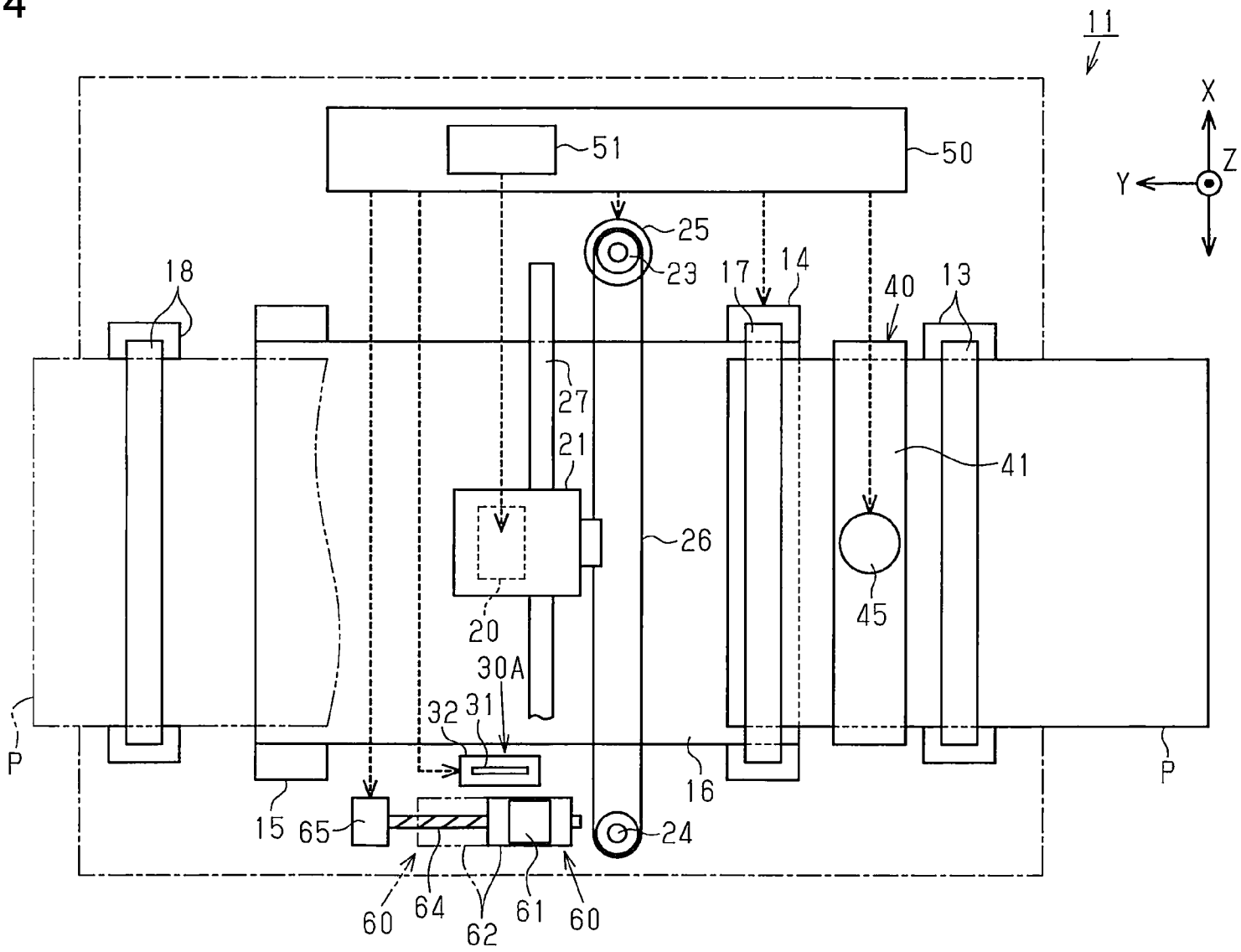
FIG. 4 is a plan view schematically illustrating the configuration of a liquid ejecting apparatus of a second embodiment.
Figure 5:
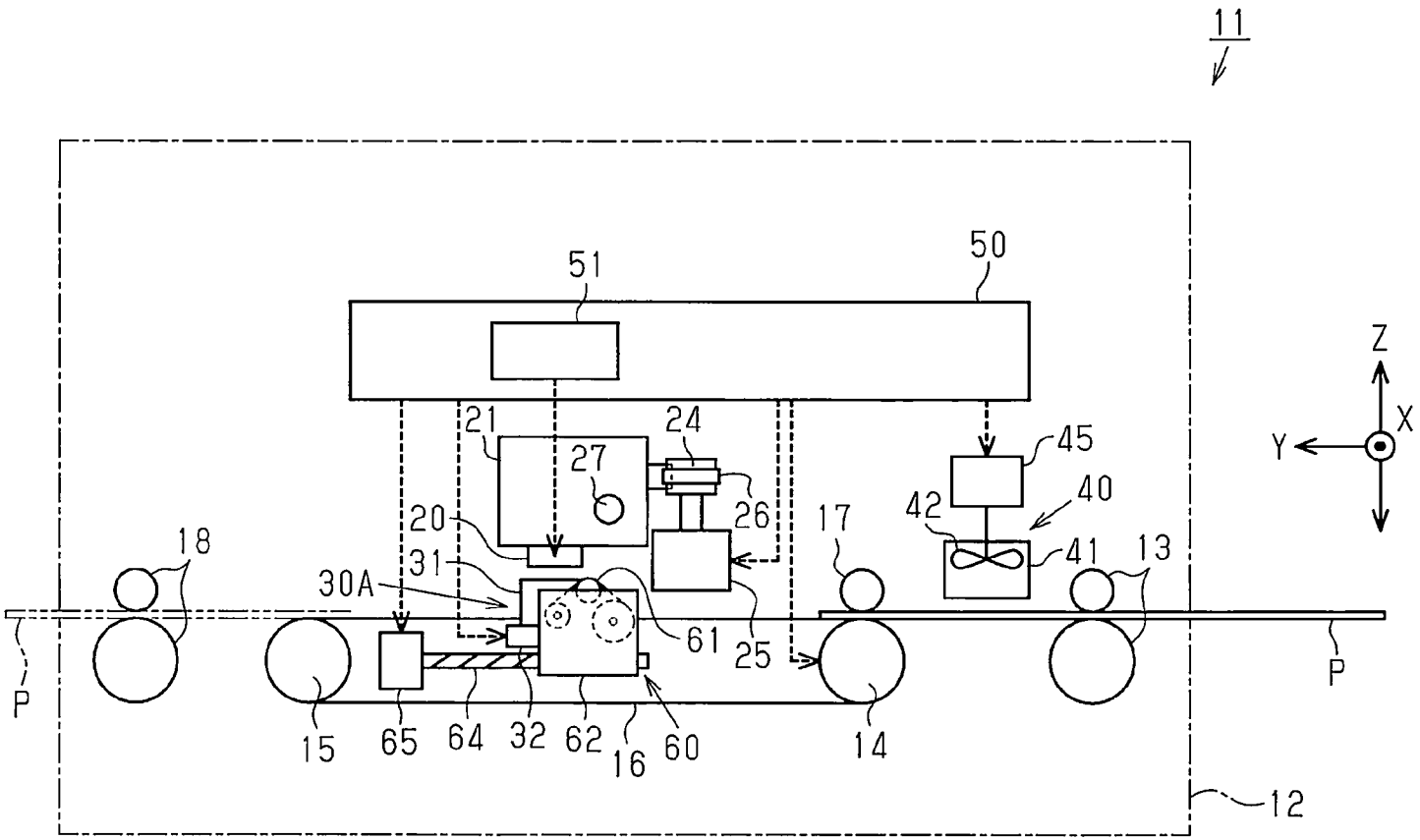
FIG. 5 is a side view schematically illustrating the configuration of the liquid ejecting apparatus of the second embodiment.

As illustrated in FIGS. 4 and 5, the liquid ejecting apparatus 11 of the second embodiment is a serial head type ink jet printer which discharges (ejects) an ink which is an example of a liquid from the liquid ejecting head 20, which is capable of moving in the width direction X of the paper P, onto the paper P which is an example of a medium to print (record) an image or the like including characters and figures.

In other words, the liquid ejecting apparatus 11 is provided with a carriage guide shaft 27 which is provided to bridge the inside of the main body case 12 and a carriage 21 which is guided by the carriage guide shaft 27 to be capable of reciprocal movement along the width direction X of the paper P. The carriage 21 is fixed to a portion of an endless timing belt 26 at the rear side which is the upstream side in the transport direction Y of the paper P. The timing belt 26 is stretched across two pulleys 23 and 24 which are installed inside the main body case 12 and a carriage motor 25 which is joined to rotationally move in an integral manner with one pulley 23 revolves due to being rotationally driven forward or backward by rotational drive signals which are output from the control unit 50. The carriage 21 which is fixed to the timing belt 26 which revolves moves reciprocally along the width direction X of the paper P.

The liquid ejecting head 20 which discharges (ejects) the ink is provided on the bottom portion of the carriage 21 on the gravity direction side in the vertical direction Z. Therefore, the liquid ejecting head 20 moves reciprocally along the width direction X of the paper P together with the carriage 21. A cartridge (not illustrated) in which the ink is stored is loaded, to be attachable and detachable, on the top portion of the carriage 21 on the anti-gravity direction side in the vertical direction Z.

A plurality (a plurality of rows) of nozzles (not illustrated) which discharge the ink which is supplied from a cartridge onto the paper P which is transported on the support belt 16 by the feed roller 17 are formed in the liquid ejecting head 20 as a plurality of nozzle rows which are lined up along the transport direction Y, leaving a predetermined interval in the width direction X. The liquid ejecting head 20 is provided with drive elements such as piezoelectric elements, which cause the ink to be discharged, corresponding to each of the nozzles which are formed. Due to the predetermined drive signal which is output to the liquid ejecting head 20 being input to the drive elements, the ink is discharged from the nozzles (the nozzle rows) of the liquid ejecting head 20 which moves in the width direction X onto the paper P which is supported and transported by the support belt 16 which revolves and an image or the like is printed onto the paper P by ink dots of predetermined sizes being formed.

In this embodiment, the liquid ejecting apparatus 11 is provided with two wipers of a first wiper 30A and a second wiper 60. The first wiper 30A includes the wiper blade 31 which is an example of a first wiping portion which is formed of rubber or an elastomer resin and the blade holding body 32 which holds the wiper blade 31. The first wiper 30A is installed on the right side of the support belt 16 as viewed from the downstream side in the transport direction Y and the blade holding body 32 is rendered capable of moving in the vertical direction Z by a lifting and lowering mechanism which is formed between the blade holding body 32 and a rotating cam 37 (refer to FIG. 6), for example. The lifting and lowering mechanism (the rotating cam 37) is driven by a drive signal which is output from the control unit 50.

The second wiper 60 includes a fabric 61 which is an example of the second wiping portion which is formed of a band-shaped member capable of absorbing the ink and a fabric holder 62 in which the fabric 61 is stored in a state of being wound in a roll shape. The second wiper 60 is installed on the right side of the first wiper 30A as viewed from the downstream side in the transport direction Y and the fabric holder 62 is rendered capable of moving along the transport direction Y which is a different direction from the width direction X, which is the relative movement direction of the first wiper 30A, by a slide mechanism.

In this embodiment, a so-called ball screw mechanism which is formed between a screw shaft 64 which is rotated by a driving source 65 and the fabric holder 62 functions as the slide mechanism and the fabric holder 62 undergoes sliding movement along the transport direction Y in accordance with the rotation of the screw shaft 64. In the same manner as the movement mechanism of the carriage 21, another mechanism such as a movement mechanism using an endless belt which is stretched across pulleys or a link mechanism may be adopted as the slide mechanism.

The slide mechanism is driven by the drive signal which is output from the control unit 50, and in accordance with the movement of the fabric holder 62 by the driven slide mechanism, the fabric 61 moves between a position on the upstream side and a position on the downstream side of the liquid ejecting head 20 along the transport direction Y which is a different direction from the relative movement direction of the wiper blade 31 of the first wiper 30A. The fabric 61 performs the wiping of the liquid ejecting head 20 according to this movement. The second wiper 60 is configured such that, in a case in which the fabric 61 is dirtied by the wiping of the liquid ejecting head 20, the dirty portion of the fabric 61 is wound up and the pre-dirtying new fabric 61 is unwound.

In the liquid ejecting apparatus 11 of this embodiment, when the maintenance by the maintenance unit 51 is not performed, that is, when the wiping does not accompany the maintenance by the maintenance unit 51, the wiping (the dry wiping) of the liquid ejecting head 20 is performed by the wiper blade 31 of the first wiper 30A. When the maintenance by the maintenance unit 51 is performed, that is, when the wiping accompanies the maintenance by the maintenance unit 51, the wiping of the liquid ejecting head 20 is performed by the fabric 61 of the second wiper 60 such that the ink which is forcefully discharged from the nozzles is sucked up.

A description will be given of the dry wiping of the liquid ejecting head 20 by the wiper blade 31 of the first wiper 30A which does not accompany the maintenance by the maintenance unit 51 and the wiping by the fabric 61 of the second wiper 60 which accompanies the maintenance by the maintenance unit 51 with reference to the drawings. The wiping (the dry wiping) of the first wiper 30A which does not accompany the maintenance is performed each time a defined number of sheets of the paper P are printed, for example.

Figure 6:
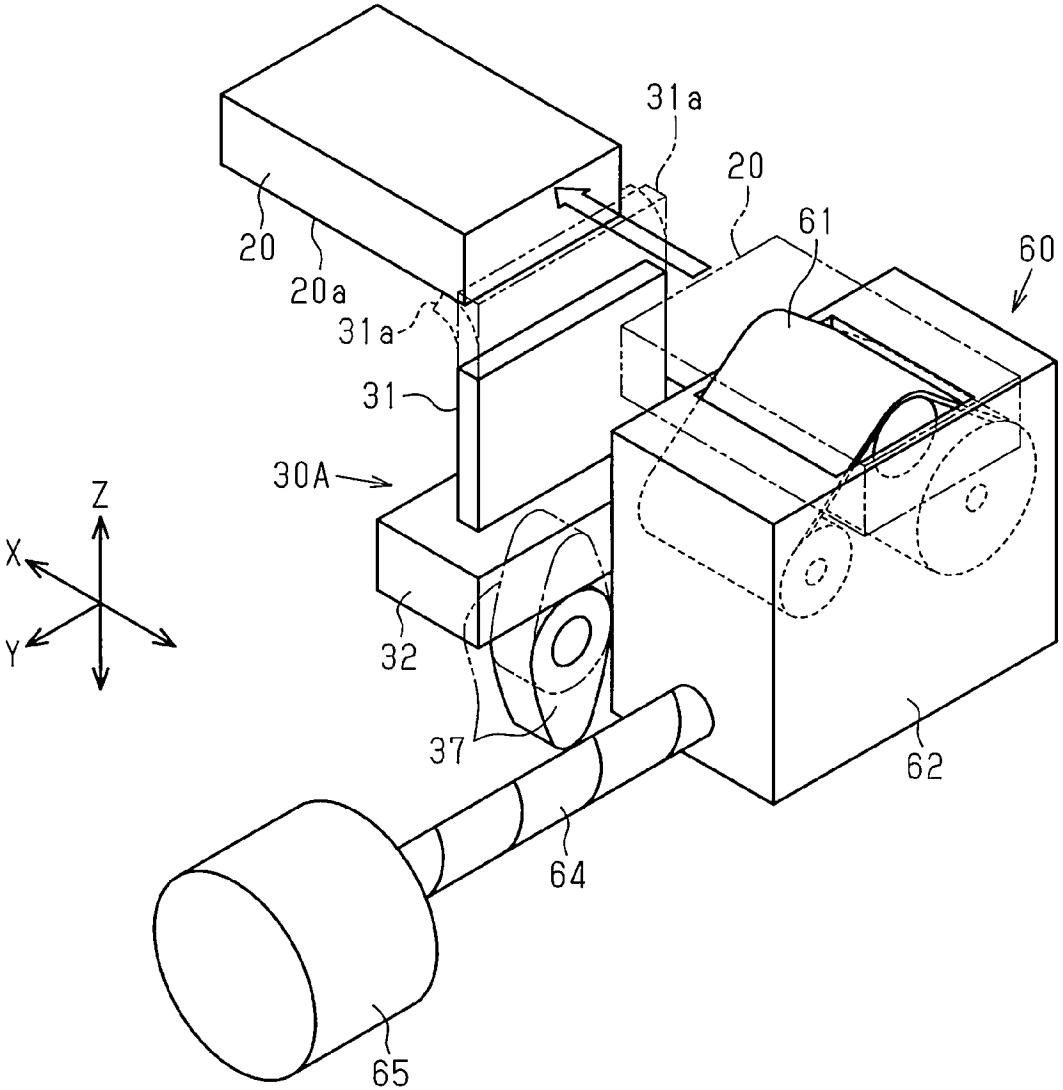
FIG. 6 is a perspective view illustrating the configuration of a first wiping portion and a second wiping portion which wipe the liquid ejecting head.

As illustrated in FIG. 6, in the dry wiping of the liquid ejecting head 20 by the first wiper 30A, first, the carriage 21 is moved in the width direction X, and the liquid ejecting head 20 is positioned on the right side as viewed from the downstream side in the transport direction Y with respect to the wiper blade 31 of the first wiper 30A as illustrated by the double-dot-dashed line in FIG. 6. At this time, the wiper blade 31 of the first wiper 30A is at a position which is separated from the liquid ejecting head 20 on the bottom side thereof in the vertical direction Z.

Next, the blade holding body 32 which serves as a cam follower of the rotating cam 37 is lifted along the vertical direction Z by the rotation of the rotating cam 37 in the lifting and lowering mechanism and, as illustrated in by the double-dot-dashed line in FIG. 6, the top end 31*a* which serves as the distal end of the wiper blade 31 is positioned closer to the anti-gravity direction side in the vertical direction Z than the bottom surface 20*a* in which the nozzles on the liquid ejecting head 20 are formed. As illustrated by the white filled arrow in FIG. 6, the liquid ejecting head 20 is moved from a position on the right side in the width direction X illustrated by the double-dot-dashed line in FIG. 6 to a position on the left side in the width direction X illustrated by the solid line in FIG. 6 with respect to the wiper blade 31. In the movement of the liquid ejecting head 20, after the wiper blade 31 comes into contact with the liquid ejecting head 20, as illustrated by the dashed line in FIG. 6, the wiper blade 31 moves toward the right side in the width direction X relative to the liquid ejecting head 20 in a state of being elastically deformed into a curved shape in which the top end 31*a* is on the left side in the width direction X.

Subsequently, although not illustrated, when the liquid ejecting head 20 moves farther to the left side in the width direction X, the contact between the top end 31*a* of the wiper blade 31 and the liquid ejecting head 20 is released. Therefore, in the wiper blade 31 which is elastically deformed into a curved shape, the top end 31*a* for which the contact with the liquid ejecting head 20 is released is moved (is displaced) by the repulsion force of the elasticity toward the right side in the width direction X which is a direction separating from the preprocessing device 40. In other words, when the wiper blade 31 separates from the liquid ejecting head 20 after performing the wiping of the liquid ejecting head 20, the wiper blade 31 moves in a direction separating from the preprocessing device 40.

Next, in the wiping of the liquid ejecting head 20 by the second wiper 60, first, the carriage 21 is moved in the width direction X and, as illustrated by the double-dot-dashed line in FIG. 6, the liquid ejecting head 20 is rendered in a state of overlapping the fabric 61 of the second wiper 60 in the transport direction Y. In this state, the fabric holder 62 is moved in the transport direction Y by the slide mechanism. In this embodiment, the top portion (the top surface) of the fabric 61 moves from the upstream side in the transport direction Y to the downstream side in the transport direction Y which is a direction separating from the preprocessing device 40 while in contact with the bottom surface 20*a* in which the nozzles on the liquid ejecting head 20 are formed to constitute nozzle rows and wipes the liquid ejecting head 20 along the nozzle rows.

Subsequently, when the second wiper 60 moves to a predetermined position on the downstream side in the transport direction Y, the contact between the fabric 61 and the liquid ejecting head 20 is released and the wiping of the liquid ejecting head 20 is completed. The liquid ejecting head 20 for which the wiping is completed moves to the left side of the second wiper 60 in the width direction X together with the movement of the carriage 21 and is prepared for the printing operation, and the second wiper 60 for which the wiping is completed returns to the position from before the wiping and is prepared for the next wiping of the liquid ejecting head 20. In a case in which the wiping of the liquid ejecting head 20 is performed by a plurality of movements of the second wiper 60 (the fabric 61) in the transport direction Y, the liquid ejecting head 20 is moved by a predetermined amount at a time such as the interval between the nozzle rows, for example, in the width direction X each time the second wiper 60 is moved a single time in the transport direction Y. After the completion of the wiping by the repeated movement of the second wiper 60 (the fabric 61) in the transport direction Y, the liquid ejecting head 20 is moved to the left side of the second wiper 60 in the width direction X and is prepared for the printing operation.

In this embodiment, in this manner, the fabric 61 (the second wiping portion) of the second wiper 60 moves in a different direction from that of the wiper blade 31 (the first wiping portion) of the first wiper 30A to perform the wiping of the liquid ejecting head 20. At this time, since the wiping (the dry wiping) of the liquid ejecting head 20 by the wiper blade 31 (the first wiping portion) is performed using the movement of the liquid ejecting head 20 in the width direction X, it is possible to suppress the occupied area in the width direction X and the transport direction Y of the first wiper 30A. Therefore, an efficient layout of the two wiping portions of the wiper blade 31 (the first wiping portion) of the first wiper 30A and the fabric 61 (the second wiping portion) becomes possible.

The liquid ejecting apparatus 11 of this embodiment may be provided with a cleaning portion (not illustrated) which performs the cleaning of the wiper blade 31 of the first wiper 30A. For example, in the same manner as the cleaning portion 19 of the first embodiment, it is favorable for the cleaning portion to be formed of an absorbent member such as a cloth or a sponge capable of absorbing the foreign matter and the ink and for the wiper blade 31 to be installed closer to the right side in the width direction X than the position at which the wiper blade 31 separates from the liquid ejecting head 20. In other words, the cleaning portion of this embodiment is provided at a position which is farther from the position at which the wiper blade 31 separates from the liquid ejecting head 20 with respect to the preprocessing device 40. In this embodiment, in a case in which the cleaning is performed by the cleaning portion of the wiper blade 31, the cleaning portion moves to a position at which the cleaning portion comes into contact with the wiper blade 31 in the width direction X.

A description will be given of the actions (operations) of the liquid ejecting apparatus 11 of the second embodiment.

In this embodiment, for the action, when executing the wiping which does not accompany the maintenance, the wiping of the liquid ejecting head 20 is performed using the first wiping portion, and when the wiping which accompanies the maintenance is executed, the wiping of the liquid ejecting head 20 is performed using the second wiping portion. In other words, here, this action is performed by the control unit 50 outputting a drive signal to the lifting and lowering mechanism (the rotating cam 37) and outputting a rotational drive signal which causes the carriage 21 to move in a period in which the control unit 50 does not output the maintenance drive signal to the liquid ejecting head 20. The action is performed by the control unit 50 (the maintenance unit 51) outputting the rotational drive signal which causes the carriage 21 to drive and outputting the drive signal to the slide mechanism after a time until the ink is forcefully discharged from the nozzles elapses after the control unit 50 outputs the maintenance drive signal to the liquid ejecting head 20.

In this embodiment, as another action, when the wiping which does not accompany the maintenance is executed after the printing, after the printing is completed and before the wiping is started, the driving of the preprocessing device 40, that is, the rotation of the fan 42 is stopped. As another action, when the wiping which does not accompany the maintenance is executed after the printing, the driving source 45 of the preprocessing device 40 stops the driving of the preprocessing device 40, that is, stops the rotation of the fan 42 by the time at which the wiper blade 31 of the first wiper 30A finishes wiping the liquid ejecting head 20.

In this embodiment, as another action, when the printing is executed after the wiping which does not accompany the maintenance, the driving source 45 of the preprocessing device 40 starts the driving of the preprocessing device 40 (the rotation of the fan 42) after a defined time is elapsed from when the liquid ejecting head 20 executes the preliminary ejection, after the wiping (the dry wiping) of the liquid ejecting head 20 by the wiper blade 31 of the first wiper 30A is performed.

According to the second embodiment, in addition to the effects (1) to (7) of the first embodiment, it is possible to obtain the following effects.

(8) Since the wiping which does not accompany the maintenance is performed by the wiper blade 31 of the first wiper 30A and the wiping which accompanies the maintenance is performed by the fabric 61 of the second wiper 60, it is possible to improve the capability to remove the foreign matter which adheres to the liquid ejecting head 20 using the two different wipers.

(9) Since the fabric 61 (the second wiping portion) of the second wiper 60 performs the wiping of the liquid ejecting head 20 in a different direction from that of the wiper blade 31 (the first wiping portion) of the first wiper 30A, it is possible to improve the capability to remove the foreign matter which adheres to the liquid ejecting head 20 by wiping in the different direction. An efficient layout of the two wiping portions of the wiper blade 31 (the first wiping portion) and the fabric 61 (the second wiping portion) becomes possible and it is possible to suppress an increase in the size of the liquid ejecting apparatus 11.

(10) Since the fabric 61 of the second wiper 60 performs the wiping of the liquid ejecting head 20 in a direction which separates from the preprocessing device 40, it is possible to suppress the foreign matter which scatters from the band-shaped member of the fabric 61 after the wiping such that the foreign matter does not reach the periphery of the preprocessing device 40. As a result, it is possible to suppress the transferring of the foreign matter onto the liquid ejecting head 20. In a case in which the foreign matter is scattered from the band-shaped member of the fabric 61 before the ink adheres to the fabric 61, since it is possible to process the foreign matter using the preprocessing device 40 which is positioned nearby, it is possible to suppress the transferring of the foreign matter from the fabric 61 to the liquid ejecting head 20.

The embodiments may also be modified as in the modification examples described below. Furthermore, the embodiments and the modification examples depicted hereinafter may be combined, as appropriate, to form further modification examples, and the following modification examples may be combined with each other, as appropriate, to form further modification examples.

In the first and second embodiments, the preprocessing device 40 may not necessarily be disposed closer to the upstream side in the transport direction Y of the paper P than the feed roller 17 which feeds the paper P to the support belt 16. For example, in a case in which the paper P is inverted in an inversion transport path after being transported from the downstream side to the upstream side in the transport direction Y and is fed from the upstream side to the downstream side in the transport direction Y toward the liquid ejecting head 20, the preprocessing device 40 may be disposed closer to the downstream side in the transport direction Y of the paper P than the feed roller 17. In this case, for example, in the first embodiment, the direction in which the wiper blade 31 separates from the preprocessing device 40 is a direction heading from the downstream side toward the upstream side in the transport direction Y which is the opposite of the transport direction Y of the paper P by the support belt 16.

In the first embodiment, the cleaning portion 19 may not be provided. Alternatively, the cleaning portion 19 may not necessarily be provided at a position farther from the preprocessing device 40 than the position at which the wiper blade 31 separates from the liquid ejecting head 20. For example, the cleaning portion 19 may be provided at the same position as the position at which the wiper blade 31 separates from the liquid ejecting head 20.

In the second embodiment, the fabric 61 (the second wiping portion) may not necessarily move in the direction separating from the preprocessing device 40 and perform the wiping of the liquid ejecting head 20. For example, the fabric 61 (the second wiping portion) may be configured to move in a direction approaching the preprocessing device 40 to perform the wiping of the liquid ejecting head 20.

In the second embodiment, the fabric 61 (the second wiping portion) may move in the same direction as the wiper blade 31 (the first wiping portion) to perform the wiping of the liquid ejecting head 20. A description will be given of the configuration of the modification example with reference to the drawings.

Figure 7:
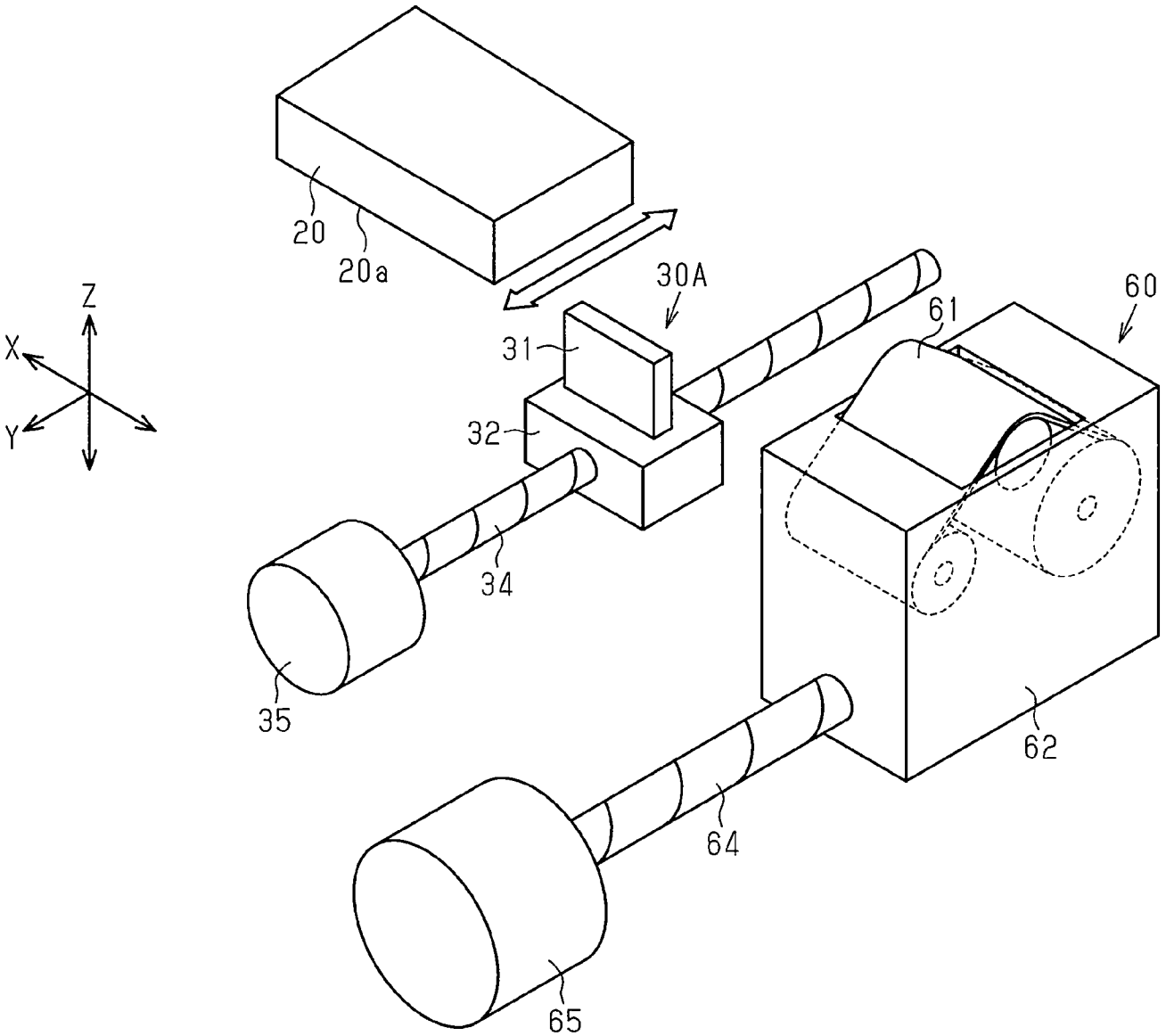
FIG. 7 is a perspective view illustrating another configuration of the first wiping portion and the second wiping portion.

As illustrated in FIG. 7, in this modification example, the first wiper 30A includes the wiper blade 31 which is an example of the first wiping portion which has a predetermined length in the width direction X and the blade holding body 32 which holds the wiper blade 31. A movement mechanism is configured between the blade holding body 32 and the screw shaft 34 which rotates according to the driving source 35 and the blade holding body 32 moves (moves reciprocally) along the transport direction Y in accordance with the rotation of the screw shaft 34. As illustrated by the white filled arrows on both sides in FIG. 7, in the same manner as the fabric 61, the wiper blade 31 moves between a position closer to the upstream side and a position closer to the downstream side than the liquid ejecting head 20 in the transport direction Y in accordance with the movement of the blade holding body 32 by the movement mechanism and performs the wiping of the liquid ejecting head 20 using the movement. In other words, the wiper blade 31 (the first wiping portion) of this modification example moves in the same direction as the fabric 61 (the second wiping portion) to perform the wiping of the liquid ejecting head 20. In other words, the fabric 61 (the second wiping portion) moves in the same direction as the wiper blade 31 (the first wiping portion) to perform the wiping of the liquid ejecting head 20.

As another configuration of the modification example, in the configuration of the second embodiment illustrated in FIG. 6, the fabric holder 62 of the second wiper 60 may be configured to move by sliding in the width direction X according to the slide mechanism. At this time, the second wiper 60 may be configured such that the fabric holder 62 does not move in the width direction X and the fabric 61 moves relatively in the width direction X due to the liquid ejecting head 20 (the carriage 21) moving in the width direction X.

In the second embodiment, the liquid ejecting apparatus 11 may not be provided with the fabric 61 (the second wiper 60) which is an example of the second wiping portion. Similarly, in the modification example illustrated in FIG. 7, the liquid ejecting apparatus 11 may not be provided with the fabric 61 (the second wiper 60) which is an example of the second wiping portion. Incidentally, in the modification example illustrated in FIG. 7, the configuration in which the second wiper 60 is not provided becomes a configuration in which, in the liquid ejecting apparatus 11 of the first embodiment illustrated in FIG. 1, the liquid ejecting head 20 is changed from a line head type to a serial head type and the length of the wiper blade 31 in the width direction X is changed to be shorter.

In the second embodiment, the second wiping portion may not necessarily be formed of a band-shaped member capable of absorbing the ink. For example, as long as the second wiping portion is a member capable of absorbing the ink, in the same manner as the first wiping portion, the second wiping portion may be formed in a wiper blade shape, and as long as it is possible to remove the ink which is discharged from the nozzles, the second wiping portion may be formed using rubber or an elastomer resin.

In the second embodiment, the wiping of the liquid ejecting head 20 may not necessarily be performed by the first wiping portion in a case in which the wiping does not accompany the maintenance and the wiping of the liquid ejecting head may not necessarily be performed by the second wiping portion in a case in which the wiping accompanies the maintenance. For example, the wiper blade 31 (the first wiping portion) of the first wiper 30A may perform both the wiping which accompanies the maintenance and the wiping which does not accompany the maintenance. At this time, the wiping direction of the wiper blade 31 in the wiping which accompanies the maintenance may be the same direction as the direction in the wiping which does not accompany the maintenance and may be the opposite direction.

In the first and second embodiments, when the driving source 45 executes the printing after the wiping which does not accompany the maintenance, the driving of the preprocessing device 40 may be started after a defined time is elapsed from when the liquid ejecting head 20 executes the preliminary ejection, after the wiping (the dry wiping) of the liquid ejecting head 20 is performed by the wiper blade 31. For example, in a case in which the meniscus inside the nozzles is stable after the wiper blade 31 performs the wiping (the dry wiping) of the liquid ejecting head 20, the liquid ejecting head 20 may not necessarily execute the preliminary ejection in which the ink is discharged separately from the printing. Therefore, in such a case, the driving source 45 may start the driving of the preprocessing device 40 directly after the dry wiping of the liquid ejecting head 20 by the wiper blade 31.

In the first and second embodiments, when the driving source 45 which drives the preprocessing device 40 executes the wiping which does not accompany the maintenance after the printing, the driving of the preprocessing device may not necessarily be stopped by the time at which the wiping of the liquid ejecting head 20 by the wiper blade 31 is completed after the printing is completed. In other words, when the driving source 45 executes the wiping which does not accompany the maintenance after the printing, the wiper blade 31 may stop the driving of the preprocessing device 40 after the wiping of the liquid ejecting head 20 by the wiper blade 31 is completed.

In the first and second embodiments, when the driving source 45 which drives the preprocessing device 40 executes the wiping which does not accompany the maintenance after the printing, the driving of the preprocessing device 40 may not necessarily be stopped before the wiping of the liquid ejecting head 20 by the wiper blade 31 is started after the printing is completed. In other words, when the driving source 45 executes the wiping which does not accompany the maintenance after the printing, the wiper blade 31 may stop the driving of the preprocessing device 40 after the wiping of the liquid ejecting head 20 by the wiper blade 31 is started.

In the first and second embodiments, the preprocessing device 40 is not necessarily a foreign matter removing device (a suction device) which is provided with the fan 42 which is caused to rotate by the driving source 45. For example, the preprocessing device 40 may be a suction device in which a brush which comes into contact with the paper P is provided on a distal end of the suction device. In other words, the preprocessing device 40 may be a suction device which is formed from a single brush and a suction unit which sucks up the foreign matter (the paper dust) which adheres to the brush. Alternatively, the preprocessing device 40 may be an electrostatic adsorption device which adsorbs the foreign matter using static electricity which is generated by the driving of the driving source. The preprocessing device 40 may be a device which combines the electrostatic adsorption device and a cleaner which removes the adsorbed a foreign matter from the electrostatic adsorption device.

In the first and second embodiments, the preprocessing device 40 may not necessarily be a foreign matter removing device which is driven by the driving source 45. For example, the preprocessing device 40 may be an adhesive roller which is a roller which comes into contact with the paper P and is driven in accordance with the movement of the paper P in the transport direction Y in which the roller surface is capable of adhering to a foreign matter, and the preprocessing device 40 may be a combination of the adhesive roller and a roller cleaner. The preprocessing device 40 may be a pressurizing roller which pressurizes the foreign matter (the paper dust) and pushes the foreign matter into the paper P. Alternatively, the preprocessing device 40 may be a brush to which the foreign matter (the paper dust) is capable of adhering. It is preferable that such a roller or brush be configured so as to be possible to attach, detach, and exchange for maintenance.

In the first and second embodiments, the preprocessing device 40 may not necessarily be a foreign matter removing device which removes at least a portion of the foreign matter which adheres to the paper P. For example, the preprocessing device 40 may be an application device which applies, to the paper P, a preprocessing liquid for promoting the fixing and the drying of the ink which is ejected (discharged) onto the paper P from the liquid ejecting head 20. The application device is disposed on the upstream side of the liquid ejecting head 20 in the transport direction and is capable of suppressing the scattering of the paper powder itself by applying the preprocessing liquid to the paper P. Naturally, when the wiper blade 31 and the liquid ejecting head 20 are separated, since the wiper blade 31 moves (is displaced) in a direction which separates from the application device, the foreign matter does not easily reach the periphery of the application device and the foreign matter having a high likelihood of ink adhering thereto does not easily reach the periphery of the application device. Therefore, it is possible to suppress deterioration in the application capability of the application device caused by dirt or the like. Since it is possible to cause the liquid which is ejected onto the paper P to dry quickly, high-speed printing becomes possible.

In the first and second embodiments, other than being automatically performed each time a defined number of sheets of the paper P are printed, the wiping which does not accompany the maintenance may be performed when an execution command is input from an input unit by a user of the liquid ejecting apparatus 11.

In the first embodiment, the wiper blade 31 may wipe the line head type liquid ejecting head 20 in the width direction X which is the longitudinal direction instead of wiping the liquid ejecting head 20 in the transport direction Y which is the short direction. Naturally, in this case, when the wiper blade 31 separates from the liquid ejecting head 20 after performing the wiping of the liquid ejecting head 20 when executing the wiping which does not accompany the maintenance, the wiper blade 31 moves in a direction separating from the preprocessing device 40.

In the second embodiment, the liquid ejecting apparatus 11 may be an on-carriage type which holds a cartridge which stored the ink to be supplied to the liquid ejecting head 20 in the carriage 21 and may be an off-carriage type in which the ink tank which stores the ink is disposed at a position which is not on the carriage 21.

The liquid that is ejected (discharged) by the liquid ejecting head 20 is not limited to an ink, and may be, for example, a liquid-state body in which particles of a functional material are dispersed or mixed into a liquid. For example, a configuration may be adopted in which the liquid ejecting apparatus 11 ejects a liquid-state body which contains a material such as an electrode material or a color material (pixel material) in the form of a dispersion or a solution. The electrode material or the color material may be used in the manufacture or the like of liquid crystal displays, electro-luminescence (EL) displays, and surface emission displays.

Hereinafter, a description will be given of the technical ideas to be ascertained from the embodiments and the modification examples and the operations and effects thereof.

Idea 1

A liquid ejecting apparatus includes a liquid ejecting head which performs a printing by ejecting liquid onto a medium from a nozzle, a wiping portion which wipes the liquid ejecting head by moving relative to the liquid ejecting head, a maintenance unit which performs a maintenance to forcibly discharge the liquid from the nozzle, and a preprocessing device which performs a preprocessing on the medium before the printing is performed, in which when the wiping portion and the liquid ejecting head are separated from each other in the wiping not accompanying the maintenance, the wiping portion is displaced in a direction away from the preprocessing device.

In this configuration, since the foreign matter which flies when the liquid ejecting head and the wiping portion are separated does not easily reach the periphery of the preprocessing device, it is possible to suppress a deterioration in the processing capability of the preprocessing device caused by the foreign matter.

Idea 2

In the liquid ejecting apparatus according to Idea 1, the wiping portion performs the wiping of the liquid ejecting head by moving in a wiping direction, and when the wiping portion separates from the liquid ejecting head in the wiping not accompanying the maintenance, the wiping portion moves in the direction away from the preprocessing device.

In this configuration, since the foreign matter which flies when the liquid ejecting head and the wiping portion are separated does not easily reach the periphery of the preprocessing device, it is possible to suppress a deterioration in the processing capability of the preprocessing device caused by the foreign matter.

Idea 3

In the liquid ejecting apparatus according to Idea 1 or Idea 2, the preprocessing device is a foreign matter removing device which performs a process of removing at least a portion of a foreign matter which adheres to the medium as the preprocessing.

In this configuration, since the foreign matter which flies when the liquid ejecting head and the wiping portion are separated does not easily reach the periphery of the foreign matter removing device, it is possible to suppress a deterioration in the foreign matter removal processing capability of the foreign matter removing device caused by dirt or the like.

Idea 4

The liquid ejecting apparatus according to any one of Idea 1 to Idea 3 further includes a driving source which drives the preprocessing device, in which when the wiping not accompanying the maintenance is executed after the printing, the driving of the preprocessing device is stopped after the printing is completed and before the wiping is started.

In this configuration, since the probability of the foreign matter which is removed from the liquid ejecting head reaching the periphery of the preprocessing device is lowered, it is possible to suppress a deterioration in the processing capability of the preprocessing device caused by dirt or the like.

Idea 5

The liquid ejecting apparatus according to any one of Idea 1 to Idea 3 further includes a driving source which drives the preprocessing device, in which when the wiping not accompanying the maintenance is executed after the printing, the driving of the preprocessing device is stopped by a time at which the wiping of the liquid ejecting head by the wiping portion is completed.

In this configuration, since the probability of the foreign matter which is removed from the liquid ejecting head reaching the periphery of the preprocessing device is lowered, it is possible to suppress a deterioration in the processing capability of the preprocessing device caused by dirt or the like.

Idea 6

In the liquid ejecting apparatus according to Idea 4 or Idea 5, the liquid ejecting head is capable of executing a preliminary ejection in which the liquid is discharged separately from the printing, and when executing the printing after the wiping not accompanying the maintenance, the driving of the preprocessing device is started by the driving source after a defined time is elapsed from a time at which the liquid ejecting head executes the preliminary ejection after the wiping.

In this configuration, it is possible to stabilize the meniscus of the liquid ejecting head and it is possible to suppress the mist which floats according to the preliminary ejection reaching the periphery of the preprocessing device by performing the preliminary ejection after the wiping.

Idea 7

In the liquid ejecting apparatus according to any one of Idea 1 to Idea 6, the wiping portion includes a first wiping portion which is formed of rubber or an elastomer resin and a second wiping portion which is formed of a band-shaped member capable of absorbing the liquid, and the wiping not accompanying the maintenance is performed by the first wiping portion and the wiping accompanying the maintenance is performed by the second wiping portion.

In this configuration, it is possible to improve the removal capability of the foreign matter which adheres to the liquid ejecting head using the two different wiping portions.

Idea 8

In the liquid ejecting apparatus according to Idea 7, the second wiping portion performs the wiping in a different direction from that of the first wiping portion.

In this configuration, it is possible to improve the removal capability of the foreign matter which adheres to the liquid ejecting head by wiping in the different direction.

Idea 9

In the liquid ejecting apparatus according to Idea 8, the second wiping portion performs the wiping in a direction which separates from the preprocessing device.

In this configuration, since it is possible to suppress the foreign matter which flies from the band-shaped member of the second wiping portion after the wiping such that the foreign matter does not reach the periphery of the preprocessing device, it is possible to suppress transferring of the foreign matter to the liquid ejecting head.

Idea 10

The liquid ejecting apparatus according to any one of Idea 1 to Idea 9 further includes a cleaning portion which performs a cleaning of the wiping portion, in which the cleaning portion is provided at a position which is farther from the preprocessing device than the position at which the wiping portion separates from the liquid ejecting head.

In this configuration, since the foreign matter which adheres to the cleaning portion does not easily reach the periphery of the preprocessing device, it is possible to suppress a deterioration in the processing capability of the preprocessing device caused by dirt or the like.

Idea 11

The liquid ejecting apparatus according to any one of Idea 1 to Idea 10 further includes a medium support unit which is provided at a position facing the liquid ejecting head and supports the medium, and a feed roller which feeds the medium to the medium support unit, in which the preprocessing device is disposed on an upstream side from the feed roller in a feed direction in which the medium is fed.

In this configuration, since the foreign matter which adheres to the medium does not easily adhere to the liquid ejecting head, it is possible to suppress discharge faults of the liquid ejecting head.

The entire disclosure of Japanese Patent Application No. 2017-152237, filed Aug. 7, 2017 is expressly incorporated by reference herein.

What is claimed is:

1. A liquid ejecting apparatus comprising:

a liquid ejecting head which performs a printing by ejecting liquid onto a medium from a nozzle;

a maintenance unit which performs a maintenance to forcibly discharge the liquid from the nozzle;

a wiping portion which wipes the liquid ejecting head by moving relative to the liquid ejecting head, wherein the wiping portion is configured to wipe the liquid ejecting head during performing the maintenance; and a preprocessing device which performs a preprocessing on the medium before the printing is performed, wherein when the wiping portion and the liquid ejecting head are separated from each other during wiping that does not accompany the maintenance by the maintenance unit, the wiping portion is displaced in a direction away from the preprocessing device.

2. The liquid ejecting apparatus according to claim 1, wherein the wiping portion performs the wiping of the liquid ejecting head by moving in a wiping direction, and wherein when the wiping portion separates from the liquid ejecting head in the wiping not accompanying the maintenance, the wiping portion moves in the direction away from the preprocessing device.

3. The liquid ejecting apparatus according to claim 1, further comprising:

a drive source which drives the preprocessing device, wherein the preprocessing device is a foreign matter removing device which performs a process of removing at least a portion of a foreign matter which adheres to the medium as the preprocessing, and wherein when executing the wiping which does not accompany the maintenance after the printing, the driving of the preprocessing device is stopped by a time at which wiping of the liquid ejecting head is completed by the wiping unit.

4. The liquid ejecting apparatus according to claim 1, further comprising:

a driving source which drives the preprocessing device, wherein when the wiping not accompanying the maintenance is executed after the printing, the driving of the preprocessing device is stopped after the printing is completed and before the wiping is started.

5. The liquid ejecting apparatus according to claim 1, further comprising:

a driving source which drives the preprocessing device, wherein when the wiping not accompanying the maintenance is executed after the printing, the driving of the preprocessing device is stopped by a time at which the wiping of the liquid ejecting head by the wiping portion is completed.

6. The liquid ejecting apparatus according to claim 4, wherein the liquid ejecting head is capable of executing a preliminary ejection in which the liquid is discharged separately from the printing, and wherein when executing the printing after the wiping not accompanying the maintenance, the driving of the preprocessing device is started by the driving source after a defined time is elapsed from a time at which the liquid ejecting head executes the preliminary ejection after the wiping.

7. The liquid ejecting apparatus according to claim 1, wherein the wiping portion includes a first wiping portion which is formed of rubber or an elastomer resin and a second wiping portion which is formed of a band-shaped member capable of absorbing the liquid, and wherein the wiping not accompanying the maintenance is performed by the first wiping portion and the wiping accompanying the maintenance is performed by the second wiping portion.

8. The liquid ejecting apparatus according to claim 7, wherein the second wiping portion performs the wiping in a different direction from that of the first wiping portion.

9. The liquid ejecting apparatus according to claim 8, wherein the second wiping portion performs the wiping in a direction which separates from the preprocessing device.

10. The liquid ejecting apparatus according to claim 1, further comprising:

a cleaning portion which performs a cleaning of the wiping portion, wherein the cleaning portion is provided at a position which is farther from the preprocessing device than the position at which the wiping portion separates from the liquid ejecting head.

11. The liquid ejecting apparatus according to claim 1, further comprising:

a medium support unit which is provided at a position facing the liquid ejecting head and which supports the medium; and a feed roller which feeds the medium to the medium support unit, wherein the preprocessing device is disposed on an upstream from the feed roller in a feed direction in which the medium is fed.

12. The liquid ejecting apparatus according to claim 1, wherein the preprocessing device is configured to suction from the medium at least a portion of a foreign matter adhered to the medium.

13. The liquid ejecting apparatus according to claim 1, wherein the preprocessing device includes a roller having an adhesive portion on an outer periphery, wherein the roller is configured to remove from the medium at least a portion of a foreign matter adhered to the medium.

* * * * *